US007154492B2

(12) United States Patent
Henmi et al.

(10) Patent No.: US 7,154,492 B2
(45) Date of Patent: Dec. 26, 2006

(54) DEVICE FOR AND METHOD OF DRIVING LUMINESCENT DISPLAY PANEL

(75) Inventors: Koji Henmi, Yonezawa (JP); Naoki Yazawa, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 447 days.

(21) Appl. No.: 10/645,669

(22) Filed: Aug. 22, 2003

(65) Prior Publication Data

US 2004/0041756 A1 Mar. 4, 2004

(30) Foreign Application Priority Data

Aug. 29, 2002 (JP) ..... 2002-251247

(51) Int. Cl.
*G09G 5/10* (2006.01)
*G09G 5/00* (2006.01)

(52) U.S. Cl. ..... 345/207; 345/77; 345/212

(58) Field of Classification Search ..... 345/76–77, 345/90, 204, 207, 212
See application file for complete search history.

(56) References Cited

U.S. PATENT DOCUMENTS 6,812,651 B1 * 11/2004 Iwata et al. ..... 315/169.3
6,892,009 B1 * 5/2005 Ito et al. ..... 385/49
6,950,098 B1 * 9/2005 Brabander et al. ..... 345/207
2001/0035853 A1 * 11/2001 Hoelen et al. ..... 345/102
2002/0011978 A1 * 1/2002 Yamazaki et al. ..... 345/87

FOREIGN PATENT DOCUMENTS

JP 9-232074 9/1997

* cited by examiner

*Primary Examiner*—Sumati Lefkowitz
*Assistant Examiner*—Rodney Amadiz
(74) *Attorney, Agent, or Firm*—Westerman, Hattori, Daniels & Adrian, LLP.

(57) ABSTRACT

Provided is a driving device that enables compensating for the decrease in luminance characteristic due to the aging of an EL display panel. On a transparent substrate 11 made of, for example, glass, there are lamination-formed a number of luminescent elements 20. By this, a light from the luminescent element is radiated, via the transparent substrate, in a direction of its intersecting a substrate surface thereof, thereby a display image is formed. The driving device is equipped with photo-electric conversion means 23 that, when receiving part of the light from the luminescent element 20 that, by using as the interface a substrate surface of the transparent substrate 11 or a substrate surface of a light-guiding substrate 72 disposed on the transparent substrate 1 in a laminated state, is reflected within the substrate, produces an electric signal, as well as drive power setting means 25 that sets a luminescent drive power that is supplied to each of the luminescent elements. By this construction, it is possible to compensate for the decrease in luminance characteristic due to, for example, the aging of the luminescent element 20.

14 Claims, 14 Drawing Sheets

DEVICE FOR AND METHOD OF DRIVING LUMINESCENT DISPLAY PANEL

BACKGROUND OF THE INVENTION

1. Field of the Invention

The present invention relates to a technique that drives a luminescent display panel that is equipped with, for example, an organic electroluminescent (EL) element as its luminescent element, and, more particularly, to a device for and a method of driving a luminescent display panel that can set the luminance of its EL element to a state that is suitable.

2. Description of the Related Art

As a display device that is low in power consumption, high in displayed quality, and can be thinned and that can be used instead of a liquid crystal display device, attention has been drawn toward an EL display device. On the background of this, there exists also the circumstance where the EL display device has progressively been streamlined, life-extended, and able to resist the practical use by using as the luminescent layer of the EL element used in the EL display device an organic compound from which good luminescent characteristics can be expected.

The organic EL element can electrically be expressed as an equivalent circuit such as that illustrated in FIG. 1. Namely, the organic EL element can be replaced with a construction of a parasitic capacitor component C and a diode component E that is connected in parallel to this capacitor component. The organic EL element therefore is thought to be a luminescent element with the property as a capacitance. When applied with a luminescent drive voltage, first, the organic EL element has entered into its electrode as the displacement current an electric charge corresponding to the electric capacitance of the element, and that electric charge is accumulated. Subsequently, when the resulting voltage has exceeded a prescribed voltage (the luminescent threshold voltage=Vth) specific for the element, an electric current starts to flow from the electrode (the anode side of the diode component E) into an organic layer constructing the luminescent layer. It can therefore be thought that luminescence occurs with an intensity that is proportionate to the electric current.

FIG. 2 illustrates the luminescence characteristic of the organic EL element. According to the luminescence characteristic, as illustrated in FIG. 2A, the organic EL element luminesces at a luminance (L) that is substantially proportionate to the drive current (I). As illustrated by a solid line in FIG. 2B, in case where the drive voltage (V) is equal to or higher than the luminescent threshold voltage (Vth), the electric current (I) rapidly flows, followed by luminescence. In other words, in case where the drive voltage is lower than the luminescent threshold voltage (Vth), almost no electric current flows into the EL element, followed by no luminescence. Accordingly, the luminance characteristic of the EL element has such a tendency as is that, as illustrated by a solid line in FIG. 2C, in the region of enabling luminescence where the relevant voltage is higher than the threshold voltage (Vth), the greater the value of the voltage (V) applied to the element is, the higher the luminance (L) becomes.

By the way, the above-described organic EL element has a characteristic that due to its long use the physical property of the element changes and the resistance value of the element itself becomes great. For this reason, as illustrated in FIG. 2B, in the organic EL element, the V-I characteristic thereof changes toward a direction indicated by the arrow (the characteristic indicated by a broken line) depending on the time period in which the element is put to practical use. Accordingly, the luminance characteristic also decreases. Also, the organic EL element has a problem, too, that the initial luminance thereof has a variation due to the variation in, for example, the deposition, as well, at the time of forming the relevant film. This is followed by the difficulty of expressing a luminance gradation that strictly corresponds to an input image signal.

For example, there has been proposed as one means for realizing a full-color display image by an organic EL element a parallel type RGB method wherein an organic material capable of causing the luminescence of red (R), green (G), and blue (B) color lights is separately formed and they are arrayed. In a full-color display device utilizing that RGB method, the totaled luminescing time period of a respective one of the R, G, and B elements is different, and, in addition, depending on the luminescent materials of the respective organic EL elements constituting the R, G, and B luminescent pixels, the speeds at which the respective values of luminance decrease are different. Therefore, the device has the problem that, with the passage of use time period, the color balance (white balance) after all collapses.

Further, it is also known that the luminance characteristic of the organic EL element generally changes with temperature in the way indicated by broken lines in FIG. 2C. Namely, while the EL element has such a tendency that, in the region of enabling luminescence where the relevant voltage is higher than the above-described luminescent threshold voltage, the greater the value of the voltage (V) applied thereto becomes, the higher the luminance (L) thereof becomes, the luminescent threshold voltage becomes lower as the temperature rises. Accordingly, the EL element is brought to a state of its luminescence being enabled with the voltage applied that is more decreased as the temperature increases. Therefore, the EL element has the dependency on temperature of luminance that, even if applied with the same luminescence-enabling voltage, when the temperature is high, the luminance is high and, when the temperature is low, the luminance is low.

Accordingly, in a case where realizing a full-color display image by the above-described parallel type RGB method, the device comes to have a problem that, due to the change in environmental temperature, as well, the color balance of R, G, and B similarly collapses.

SUMMARY OF THE INVENTION

The present invention has been made in view of the above-described technical problems and has an object to provide a device for and a method of driving a luminescent display panel which enable effectively suppressing the change in the luminance characteristic due to the aging or the change in the luminance due to the variation in the environmental temperature.

A device for driving a luminescent display panel according to the present invention that has been achieved in order to attain the above object is a device for driving a luminescent display panel, the device for driving a luminescent display panel being adapted to obtain a display image by lamination-forming on a transparent substrate a luminescent element including an electrode and a luminescent function layer and causing a light from the luminescent element to be radiated via the transparent substrate in a direction of its intersecting the surface of the substrate at a right angle with respect thereto, which comprises photo-electric conversion means that receives the light from the luminescent element which, by using as the interface the substrate surface of the transparent substrate or a substrate surface of a light guiding substrate disposed on the transparent substrate in a laminated state, is reflected within the substrate, to thereby produce an electric signal, and drive power setting means that, according to the electric signal obtained from the photo-electric conversion means, sets a luminescent drive power that is supplied to each of the respective luminescent elements.

Also, a method of driving a luminescent display panel according to the present invention that has been achieved in order to attain the above object is a method of driving a luminescent display panel, the method of driving a luminescent display panel being adapted to obtain a display image by lamination-forming on a transparent substrate a luminescent element including an electrode and a luminescing function layer and causing a light from the luminescent element to be radiated via the transparent substrate in a direction of its intersecting the surface of the substrate at a right angle with respect thereto, which comprises the step of receiving the light from the luminescent element which, by using as the interface the substrate surface of the transparent substrate or a substrate surface of a light guiding substrate disposed on the transparent substrate in a laminated state, is reflected within the substrate, to thereby produce an electric signal, and the step of executing a setting operation of setting a luminescent drive power that is supplied to each of the respective luminescent elements according to the electric signal.

DESCRIPTION OF THE PREFERRED EMBODIMENTS

Figure 1:
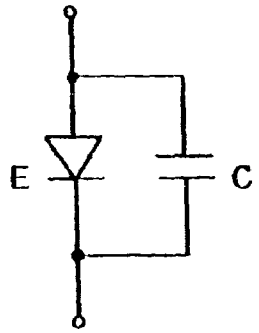
FIG. 1 (Prior Art)
FIG. 1 is an electric circuit diagram that represents an EL element as an equivalent circuit thereof.
Figure 2:
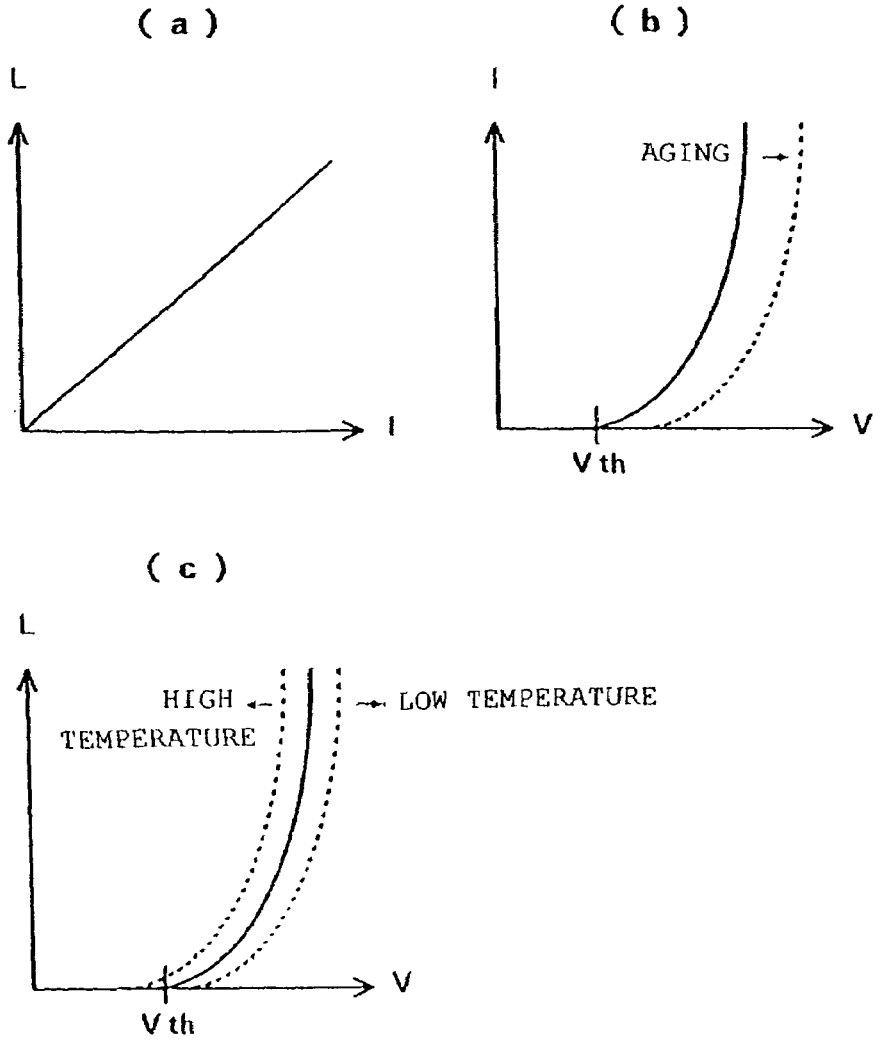
FIG. 2 (Prior Art)
FIGS. 2A, 2B, and 2C are characteristic diagrams illustrating various characteristic of an organic EL element.
Figure 3:
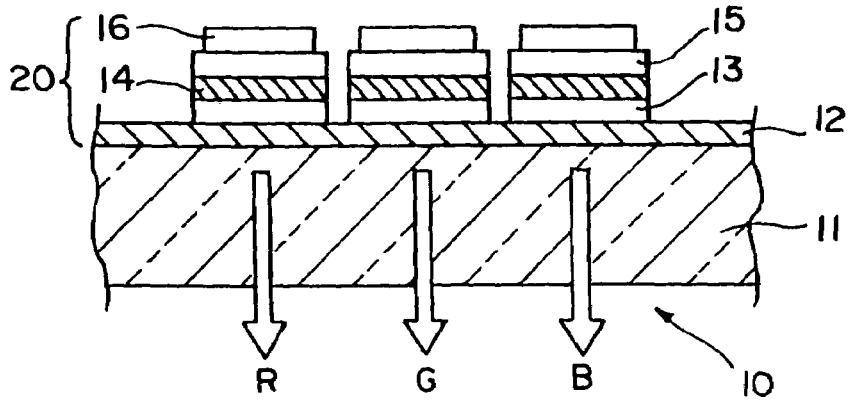
FIG. 3 is a sectional view illustrating an example of a luminescent display panel in which the present invention can be suitably adopted.

Hereinafter, an embodiment of the present invention will be explained with reference to the drawings. First, FIG. 3 illustrates by a sectional view a luminescent display panel 10 that enables suitably adopting therein the present invention. In this example, illustration is made of a full-color display panel, based on the use of a parallel type RGB method, wherein organic EL luminescent layers that luminesce respective ones of R(red), G(green), and B(blue) are separately formed and arrayed. The luminescent display panel 10, as illustrated in FIG. 3, has sequentially laminated on, for example, a transparent glass substrate 11 an anode electrode 12 made using an ITO, etc., a hole transporting layer 13 serving as a luminescent-functional layer, a luminescent layer 14, an electron-transporting layer 15, and a cathode electrode 16 in the order mentioned. These constitute a luminescent element (organic EL element) 20.

And, as the material of the luminescent layer 14 there are used organic compounds capable of luminescing respective color lights of the R(red), G(green), and B(blue) colors. By using the respective colors of the R, G, and B as the sub-pixels and causing the lights having R, G, and B colors to be radiated, via the substrate 11, in a direction intersecting the substrate surface at a right angle with respect thereto, like that, it is possible to obtain a full-color display image. Incidentally, the device for driving a luminescent display panel according to the present invention is not only utilized in the above-described full-color display panel but is also utilized in a mono-chromatic luminescent display panel that uses as the luminescent layer 14 an organic material capable of luminescing the same color light, or also utilized in a multi-color luminescent display panel that is constructed in the way that the whole region of the display panel is divided into several parts so that different color lights may be radiated.

By the way, in the above-constructed luminescent display panel 10, the light from the luminescent layer 14 is radiated not only in the direction intersecting the substrate surface of the glass substrate 11 at a right angle with respect thereto but also in all directions. Accordingly, partial light that is radiated from the luminescent layer 14 enters the substrate 11 at a prescribed angle as viewed with respect thereto, whereby the phenomenon that the incident light is totally reflected within the substrate 11 by using the substrate surface as the interface occurs. The inventors of this application have the knowledge of that, by measuring the totally reflected amount of light by adopting several means such as those described later, it is possible to grasp the instantaneous luminance of the EL element in the luminescent display panel. In addition, they also verify, in regard to the measured result, as well, that a relatively high level of precision is obtained.

Figure 4:
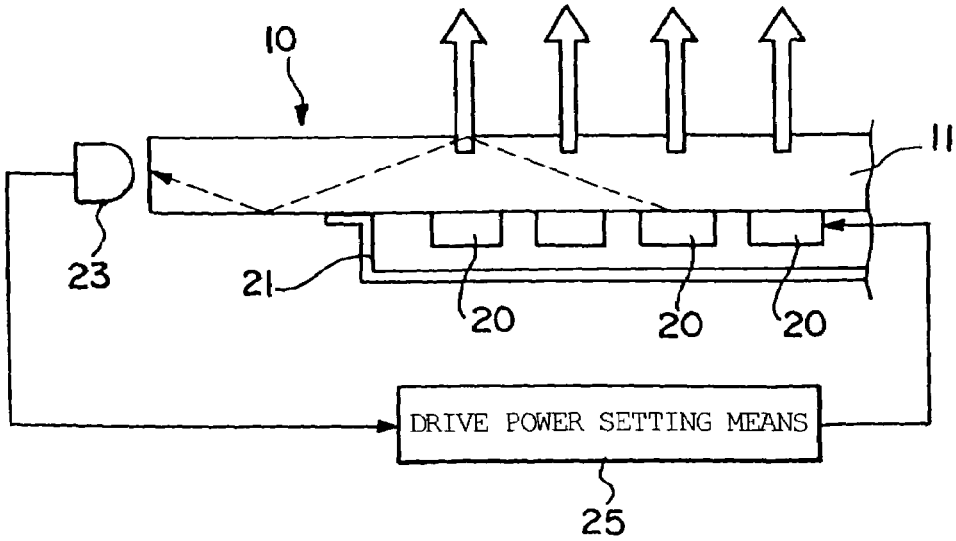
FIG. 4 is a sectional view illustrating a first embodiment wherein there is detected an amount of light reflected within a substrate.

FIG. 4 illustrates, by a typical view, the basic construction according to the present invention, which is arranged, from the above-described point of view, to detect the amount of light that is totally reflected within the substrate with the substrate surface serving as the interface and to set, according to that detected value, a luminescent drive power that is supplied to the luminescent element (EL element). Namely, as illustrated in FIG. 4, on one surface of the glass-made transparent substrate 11 that forms the luminescent display panel 10, there is formed the luminescent element 20 including the luminescent layer 14 as stated above. And, one surface of the substrate 11 having formed thereon the luminescent element 20 is sealed by a sealant 21 that is made of, for example, a stainless steel.

According to the construction illustrated in FIG. 4, partial light that is radiated from the luminescent element 20 and goes into the substrate surface of the substrate 11 at an angle that is prescribed or smaller than prescribed when viewed with respect thereto is totally reflected within the substrate 11 with the substrate surface serving as the interface as indicated by a broken line. And, the light that has been totally reflected within the substrate 11 arrives at the end surface of the transparent substrate 11. At the end surface, the incident angle becomes greater than the prescribed angle. Therefore, the light transmits through the end surface of the substrate 11. In the form illustrated in FIG. 4, at the end surface of the transparent substrate 11 constituting the luminescent display panel 10 there is disposed a light-receiving element that serves as photo-electric conversion means 23, for example, a PIN diode.

In this construction, the instantaneous luminance that is radiated from the luminescent element 20 can be converted to an electric signal by the PIN diode. The signal that is produced by the PIN diode and that corresponds to the luminance is supplied to the drive power setting means 25. It then is controlled so as to set to an appropriate value the luminescent drive power supplied to the luminescent element 20 formed in the display panel 10.

Figure 5:
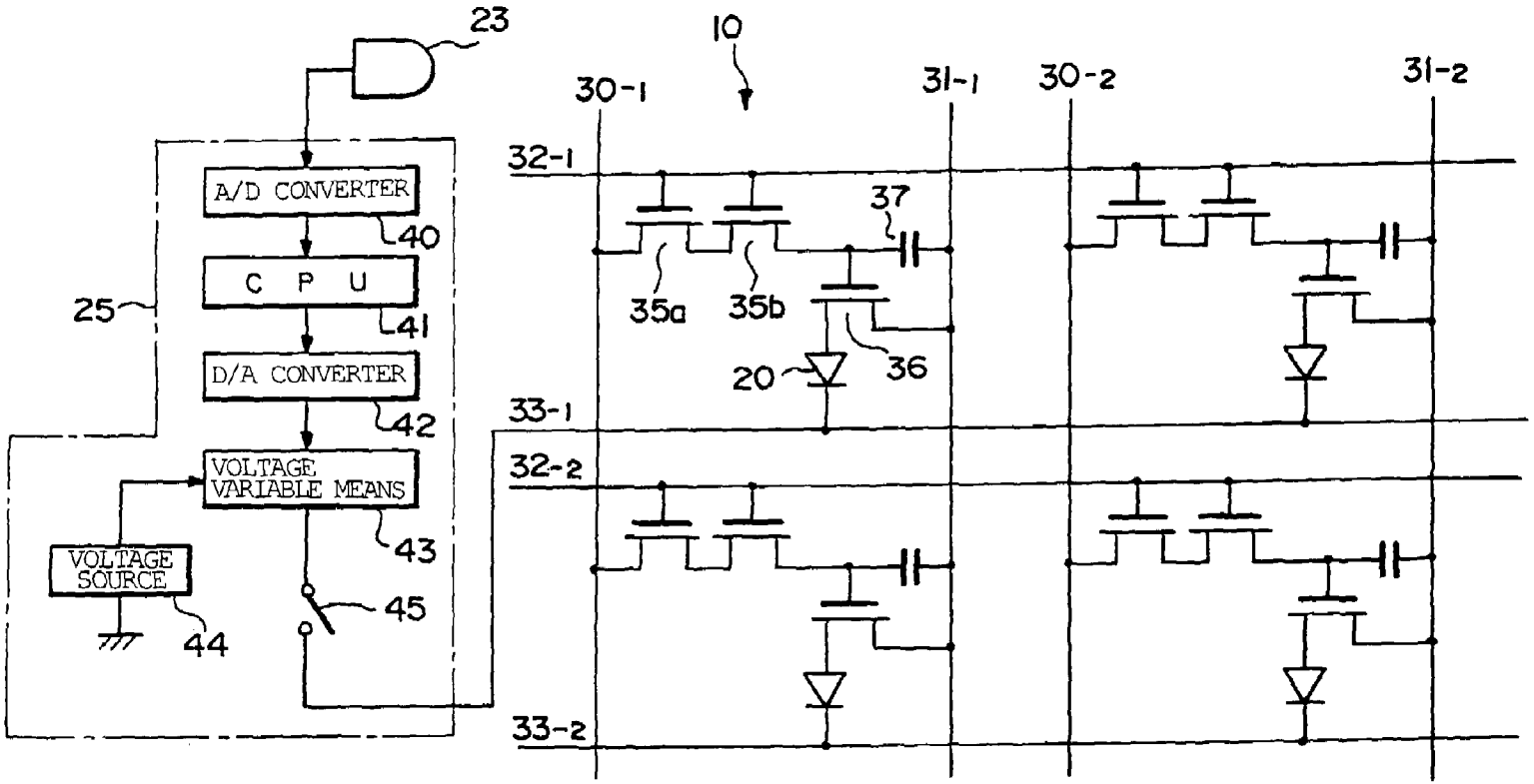
FIG. 5 is a line connection diagram illustrating an example wherein the present invention is applied to a device for driving an active drive type display panel.

FIG. 5 illustrates a construction of connection where the photo-electric conversion means 23 and drive power setting means 25 illustrated in FIG. 4 and the display pixels of the display panel 10 are connected. In this example, an active drive type display panel is illustrated as the display panel 10. In the display panel 10 according to this embodiment, a number of data electrode lines 30-1, 30-2, - - - each having supplied thereto a control signal that corresponds to the image data signal from a data driver not illustrated are arrayed in the column direction. Also, in parallel with the data electrode lines, a number of reference power source lines 31-1, 31-2, - - - are also arrayed. On the other hand, a number of scanning electrode lines 32-1, 32-2, - - - each having supplied thereto a scanning signal from a scanning driver not illustrated are arrayed in the row direction while a number of power source control lines 33-1, 33-2, - - - are also arrayed in parallel with the scanning electrode lines.

And, in the circuit construction including the EL element, as the luminescent element 20, corresponding to the unit luminescent pixel, there are equipped control TFTs (Thin Film Transistors), drive TFTs, and capacitors. In the form illustrated in FIG. 5, first TFT 35*a* and second TFT 35*b* are used as the control TFTs, and, to each of the gates thereof, there is applied via the scanning electrode line a scanning signal for scanning the row line. Also, in this embodiment, the source and the drain of each of the first control TFT 35*a* and second control TFT 35*b* are connected in series to each other. And, the source of the first control TFT 35*a* is connected to the data electrode line 30-1 and the drain of the second control TFT 35*b* is connected to the gate of the drive TFT 36 and is also connected to one end of a capacitor 37.

The other end of the capacitor 37 and, for example, the drain of the drive TFT 36 are connected to the reference potential line 31-1. The source of the drive TFT 36 is connected to the anode terminal of the EL element 20. And, the cathode terminal of the EL element 20 is connected to the power source control line 33-1. This construction mentioned just above is similarly made correspondingly to a respective one of the organic EL elements 20 arrayed in the display panel 10.

The luminescence-controlling operation of the unit pixel of the display panel 10 where a plurality of such circuits are arrayed in the row and column directions is performed in the way that an "on" voltage is supplied to the first and second control TFTs 35*a* and 35*b* within an addressing period of time. As a result of this, via the source and drain of each of the TFTs 35*a* and 35*b* that are connected in series to each other, an electric current corresponding to the image data voltage is caused to flow into the capacitor 37 and thereby is electrically charged into the same. And, the charged voltage is supplied to the gate of the drive TFT 36, with the result that the TFT 36 permits the gate voltage thereof and the electric current corresponding to the control voltage supplied to the power source control line 33-1 to flow into the organic EL element 20. By this, the EL element 20 luminesces.

On the other hand, when the gate voltage of each of the control TFTs 35*a* and 35*b* becomes an "off" voltage, the TFTs 35*a* and 35*b* are each brought to a state of its being "cut off". Accordingly, the drive TFT 36 has its gate voltage held by the electric charge that has been accumulated in the capacitor 37. And, until the next scan, the drive TFT 36 continues to supply a drive current to the organic EL element 20, thereby the luminescence of the EL element 20 also is maintained as is.

On the other hand, in FIG. 5, for example the PIN diode that serves as the photo-electric conversion means 23 is disposed at the end surface of the transparent substrate 11 constituting the display panel 10 as explained in connection with FIG. 4. And, the signal that corresponds to the above-described luminance and that is produced by the PIN diode's receiving the light is supplied to the drive power setting means illustrated in FIG. 5 as the block 25. The drive power setting means 25 is constructed of an A/D converter 40, a CPU 41 operating as the calculation-controlling function, a D/A converter 42, a voltage-variable means 43, a voltage source 44, and a switch 45.

While a specific construction example of each block constituting the drive power setting means 25 will be described later, the drive power setting means 25 operating in this embodiment operates, according to a photo-detection voltage that is produced by the PIN diode serving as the photo-electric conversion means 23, so as to appropriately set the voltage value of the power source control line 33-1, 33-2, - - - . This setting operation can be performed at the time of starting the light-up drive of the luminescent display panel, or at a fixed time (for each prescribed passage time) during the display operation of the luminescent display panel, or during an arbitrary operation mode, or through a user's operation.

For example, in case where due to the aging or due to the variation in the environmental temperature the amount of light that the photo-electric conversion means 23 receives has become smaller than a reference level value that is predetermined, the drive power setting means 25 resultantly controls so as to make smaller the voltage value of the power source control line 33-1, 33-2, - - - (or so as to draw that voltage value to a more negative side) and sets to that controlled state. As a result of this, the drive current that flows into the EL element 20 increases and, correspondingly thereto, the EL element 20 is set to a state of its luminance being increased. Also, for example, in case where due to the variation in the environmental temperature, etc. the amount of light that the photo-electric conversion means 23 receives has become greater than the reference value, the action that is reverse from that mentioned above works. As a result of this, the EL element is set to a state of its luminance being decreased.

Figure 6:
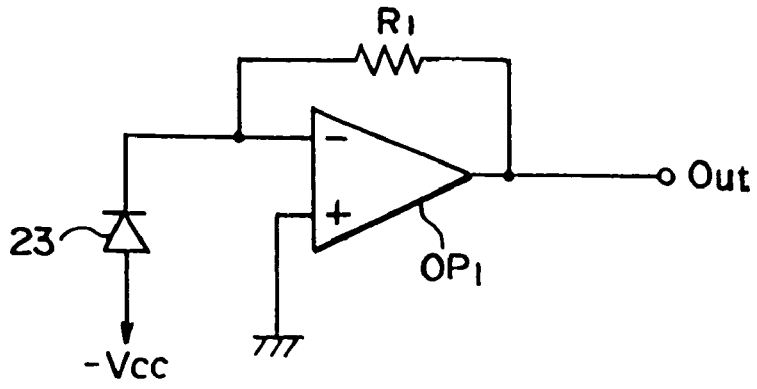
FIG. 6 is a line connection diagram illustrating an example of a photo-electric conversion circuit that takes out as an electric signal an amount of light that is reflected within the substrate.

FIG. 6 illustrates an example wherein, in case where a PIN diode is used as the photo-electric conversion means 23 as stated above, the PIN diode produces an electric signal according to the received amount of light. Namely, the output of the PIN diode is supplied to a negative feedback amplifier comprised of an operational amplifier OP1 and a feedback resistor R1. By this, at an output terminal Out of the operational amplifier OP1 a voltage that corresponds to the output of the PIN diode appears by its being impedance-converted.

Figure 7:
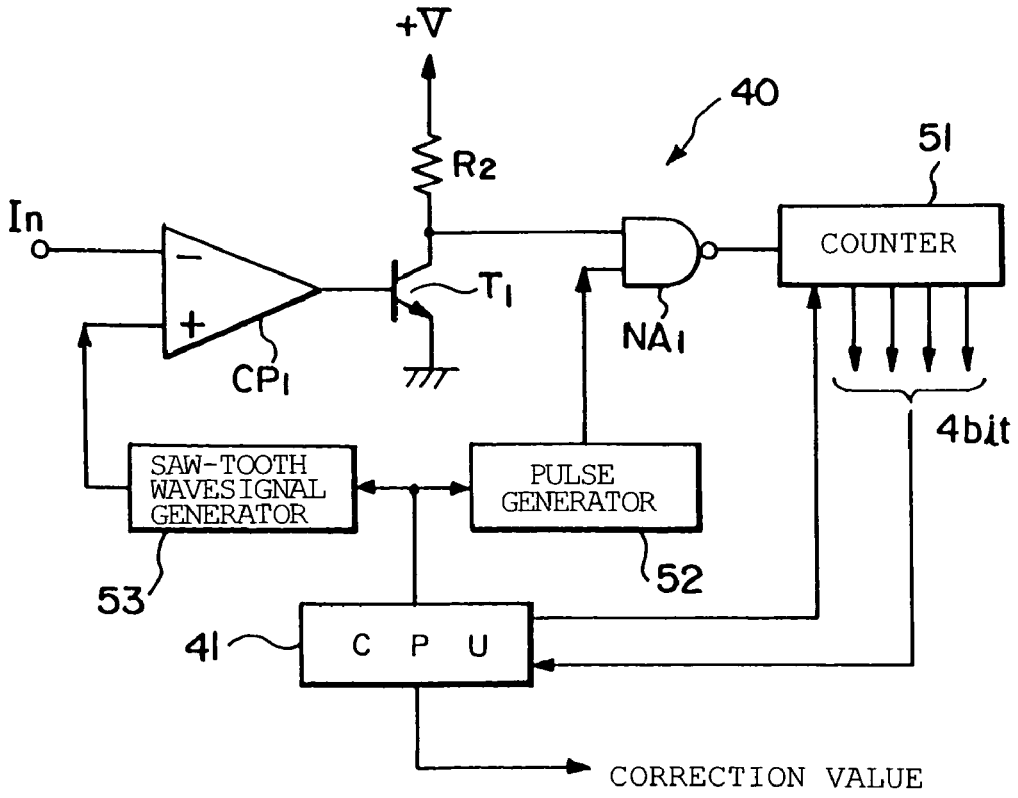
FIG. 7 is a line connection diagram illustrating an example of an A/D converter illustrated in FIG. 5.

FIG. 7 illustrates an example of the control construction wherein the control operation is performed by an A/D converter 40 for performing A/D conversion of the output that appears at the output terminal Out of the operational amplifier OP1 illustrated in FIG. 6 and the above-described CPU 41. Namely, the A/D converter 40 in FIG. 7 is constructed of a comparator CP1, a switching transistor T1 equipped with a collector resistor R2, a NAND gate NA1, a counter 51, a pulse generator 52, and a saw-tooth wave generator 53. And, from the CPU 41, a start signal is supplied from the CPU 41 to the pulse generator 52 and to the saw-tooth generator 53, and, in synchronism with this, from the CPU 41, a counter reset signal is supplied to the counter 51.

As a result of this, first, the counter value of the counter 51 is reset. Subsequently, by the pulse output from the pulse generator 52, a count-up output is supplied from the NAND gate NA1 to the counter 51, whereby the counter 51 starts to count up. On the other hand, to an inversion input terminal of the comparator CP1, the output of the operational amplifier OP1 illustrated in FIG. 6 is supplied while to a non-inversion input terminal of the comparator CP1 a saw-tooth wave signal is supplied from the saw-tooth wave generator 53. When the analog output level from the operational amplifier OP1 crosses the level of the saw-tooth wave signal from the saw-tooth wave generator 53, the comparator CP1 causes a switching of the transistor T1. As a result of this, the count-up output that is supplied from the NAND NA1 to the counter 51 is stopped from being supplied with respect thereto.

Namely, the counter 51 starts to count by its being supplied with the start signal from the CPU 41 and operates so that the counter value corresponding to a time period that has been taken from the start of counting to the point in time when the analog output level from the operational amplifier OP1 crosses the level of the saw-tooth wave signal may be supplied to the CPU 41 as a several-bit output (in the example illustrated in FIG. 7 a 4-bit output). As a result of this, the luminance information that has been obtained by the PIN diode serving as the photo-electric conversion means 23 is taken into the CPU 41 as digital data.

By receiving the digital data, as later described, the CPU 41 determined whether an initial luminance coincides with a set value. If the CPU 41 has determined that the initial value does not coincide, it outputs a correction value and, according thereto, the setting operation of setting a drive power that is applied to the EL element is executed. Incidentally, an example wherein the setting operation of setting a drive power applied to the EL element is performed through the calculation operation of the CPU 41 will be explained later in detail.

Figure 8:
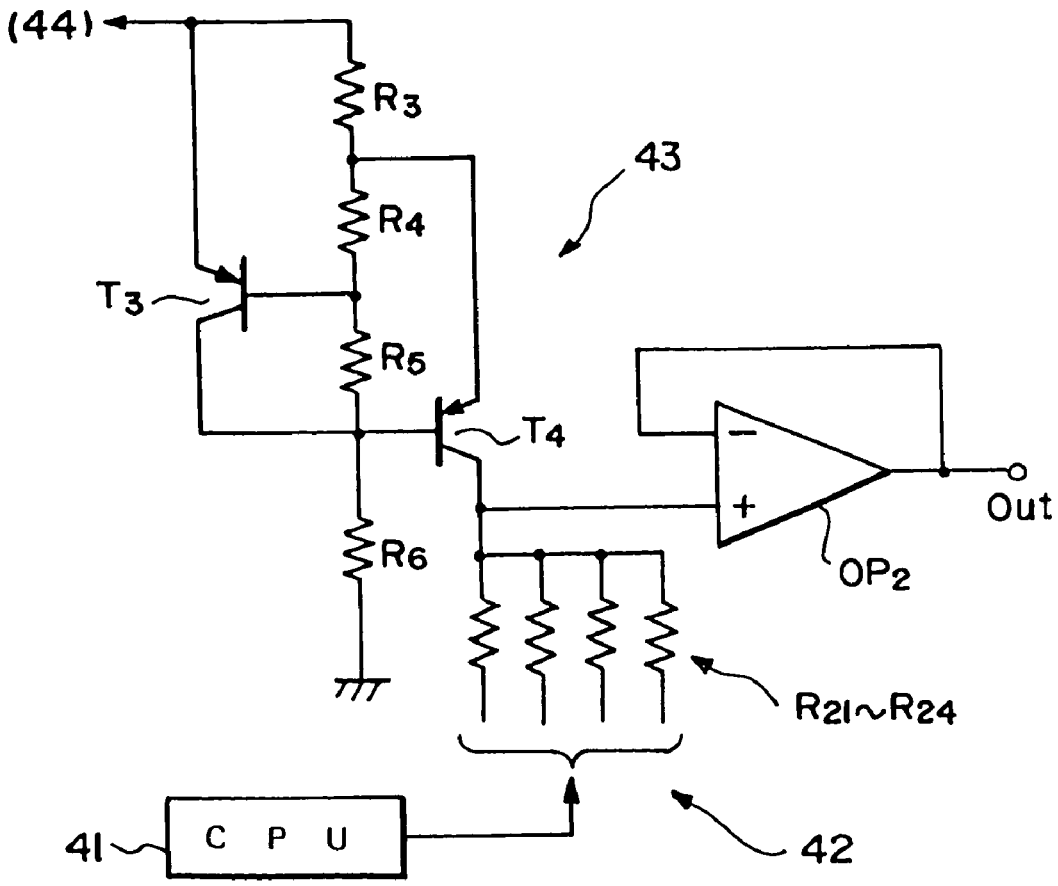
FIG. 8 is a line connection diagram illustrating an example of a D/A converter and voltage-variable means illustrated in FIG. 5.

FIG. 8 illustrates an example where in the setting operation of setting a drive power that is applied to each EL element according to the correction value that is output through the calculation operation of the CPU 41. In this example, there is illustrated a specific combination construction of the D/A converter 42 and voltage variable means 43 illustrated in FIG. 5. In the voltage variable means 43, a constant-current circuit is constructed of a pnp transistor T3 and a pnp transistor T4 that is of the same type as the former T3. Namely, to the emitter of the transistor T3 there is supplied a constant voltage from the voltage source 44 illustrated in FIG. 5. The base thereof is connected to the voltage source 44 via resistors R3 and R4. The collector thereof is connected to the base thereof with a resistor R5 existing in between. It is also connected to a reference potential point via a resistor R6.

On the other hand, the transistor T4 is connected to a point of connection between the resistor R3 and the resistor R4. The base thereof is connected to the collector of the transistor T3, and the collector thereof is connected to a respective one of one ends of resistors R21 to R24 functioning as the D/A converter 42. In this construction, when an electric current flows from the voltage source 44 into the respective resistors R3, R4, R5, and R6, a potential of 0.6 V occurs between the base and emitter of the transistor T4. Thereby, the transistor T4 is turned on. Subsequently, as a result of the electric current's flowing into the resistor R3, the voltage between the base and emitter of the transistor T3 comes to have a level of 0.6V, with the result that the transistor T3 is turned on, thereby the base current of the transistor T4 is adjusted.

As a result of this, since the voltage between the base and emitter of each of the transistors T3 and T4 is locked to a level of approximately 0.6V, the resistor R3 has a constant current allowed to flow there into, which flows into the resistors R21 to R24 connected to the collector of the transistor T4. Here, the resistors R21 to R24 are utilized for setting a drive power applied to each EL element according to the correction value that has been output through the calculation operation of the CPU 41. Namely, correspondingly to the drive power applied to each EL element which has been set by the CPU 41, the one ends of the resistors R21 to R24 are connected to, for example, the reference potential point in a selected, or combined, state.

Accordingly, in the example illustrated in FIG. 8, the collector potential of the transistor T4 is adjusted by the 4-bit control's being performed, and this collector potential is output from the output terminal Out of an operational amplifier OP2 serving as a buffer amplifier. The output voltage that occurs at the output terminal Out of the operational amplifier OP2 is supplied via the switch 45 illustrated in FIG. 5 to the power source control line 33-1, 33-2, - - - , with the result that the cathode potential of each EL element 20 is changed. As a result, the drive current value caused to flow into each EL element 20 is changed, thereby relevant adjustment is made so that the EL element 20 may have a prescribed value of luminance.

Figure 9:
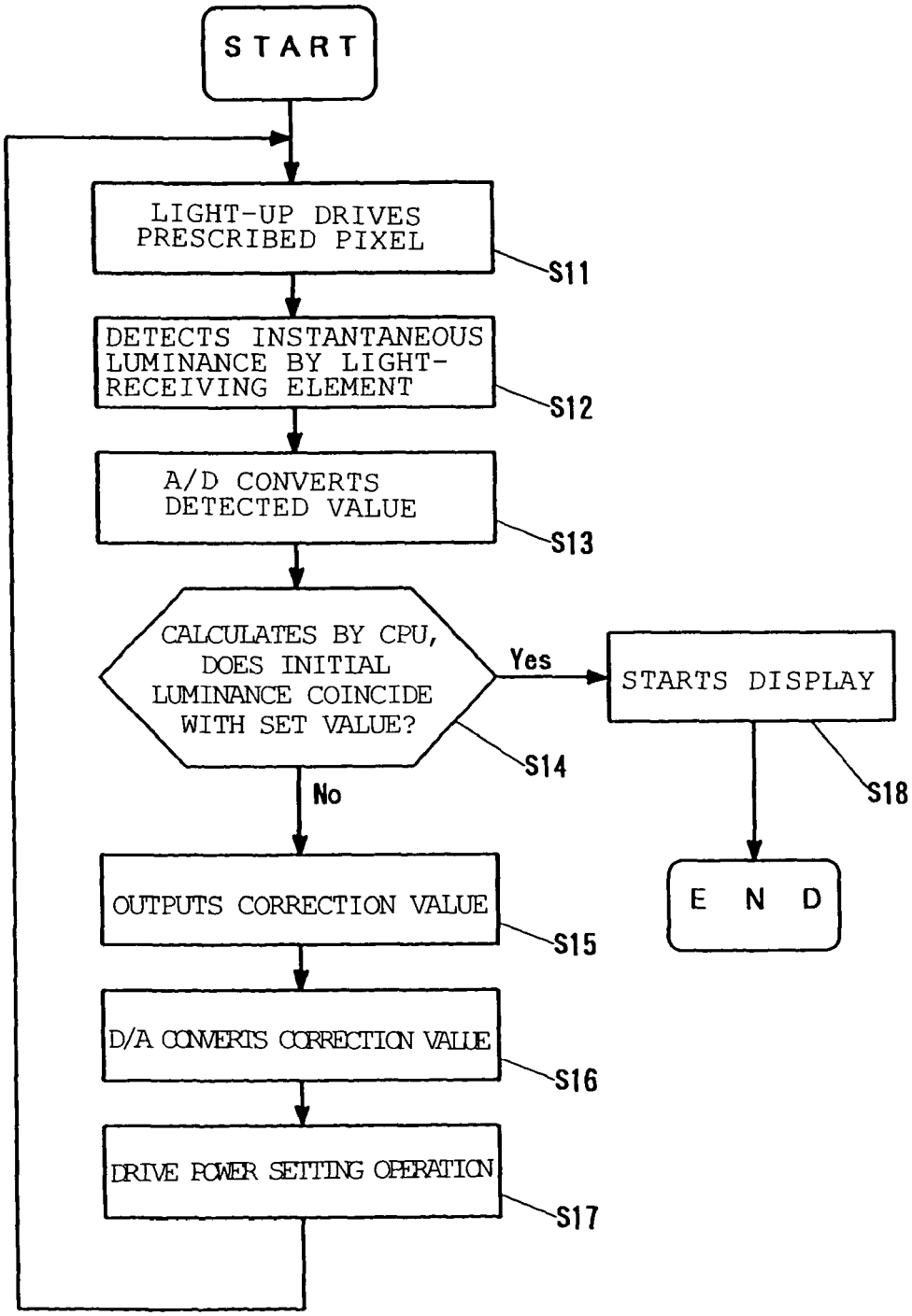
FIG. 9 is a flow chart illustrating a routine for setting a drive voltage that is applied to each EL element.

FIG. 9 illustrates a setting routine for setting a drive power with respect to each EL element, the setting of which is performed with the above-described construction. As described above, the routine illustrated in FIG. 9 is started at the time of starting the light-up drive of the luminescent display panel, or at a fixed time (for each prescribed passage time) during the display operation of the luminescent display panel, or during an arbitrary operation mode, or through a user's operation. In a step S11 after start, a prescribed pixel in the display panel 10 that is predetermined is light-up driven. Subsequently, as illustrated in a step S12, the detecting operation of detecting the instantaneous luminance that results from the light-up of the prescribed pixel that is predetermined is performed by the light-receiving element, i.e. the PIN diode.

The luminance detection output of the light-receiving element, as illustrated in a step S13, is A/D converted, and its digital data is taken into the CPU 41. This is as already explained in connection with FIG. 7. And, as illustrated in a step S14, the calculation processing is executed in the CPU 41, and it is determined, by comparison, whether the initial luminance coincides with a value that is set. Namely, in the CPU 41, there is held a set value that is set beforehand (the reference luminance data), and this preset value is compared with the digital data based on the measured luminance that has been taken into the CPU 41. And, when it is determined in the step S14 that the initial luminance does not coincide with the set value ("no" determination is made), as illustrated in a step S15 a correction value corresponding to the compared result is output.

In this case, depending on the physical positional relationship between the predetermined pixel that is light-up driven in the display panel 10 and, for example, the PIN diode serving as the photo-electric conversion means 23, the value of the digital data corresponding to the luminance taken into the CPU 41 fluctuates. Namely, as illustrated in FIG. 10A, in case where the rows of pixels formed in the display panel 10 are an m number of rows and the position of the photo-electric conversion means 23 is in the neighborhood of the upper end of the display panel 10 (the 1st row), the relationship of the detected luminance to the position of the pixel light-up driven in the display panel 10 becomes that illustrated in FIG. 10B.

Namely, as illustrated in FIG. 10B, as the position of the pixel that is light-up driven is shifted toward the lowermost row (the mth row), the luminance characteristic that is exhibited is generally attenuated. Accordingly, when the comparison-determining operation in the step S14 in FIG. 9 is performed, it is preferable to construct so that the above-described correction value may be output by using as the parameter the photo-attenuation characteristic based on the positional relationship between the position of the predetermined pixel light-up driven and the light-receiving element.

Figure 10:
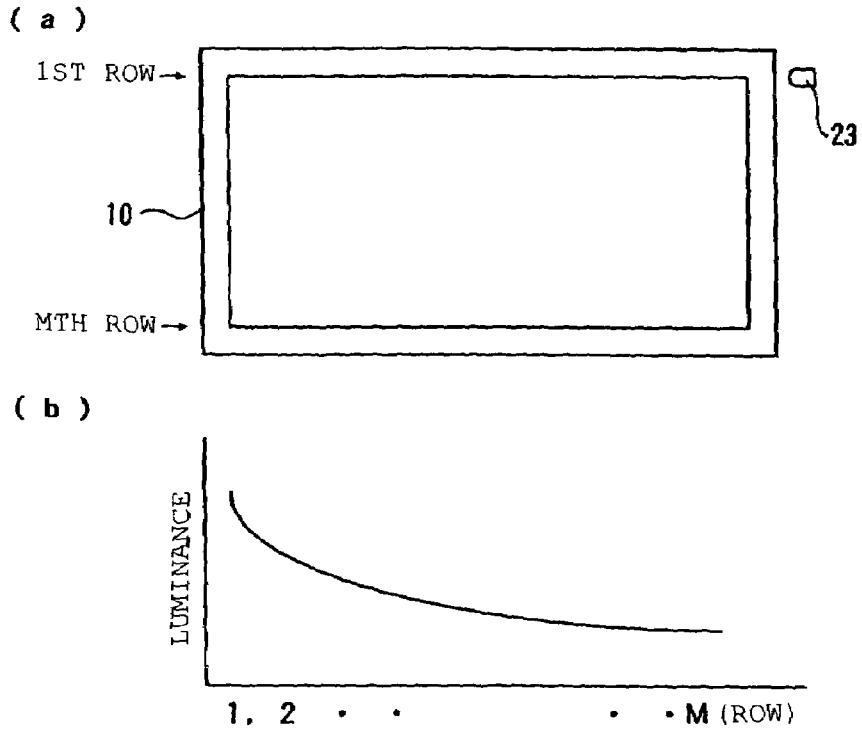
FIGS. 10A and 10B are typical views each illustrating luminance information that is obtained according to the disposition relationship between a pixel that is light-up driven in the display panel and photo-electric conversion means.
Figure 11:
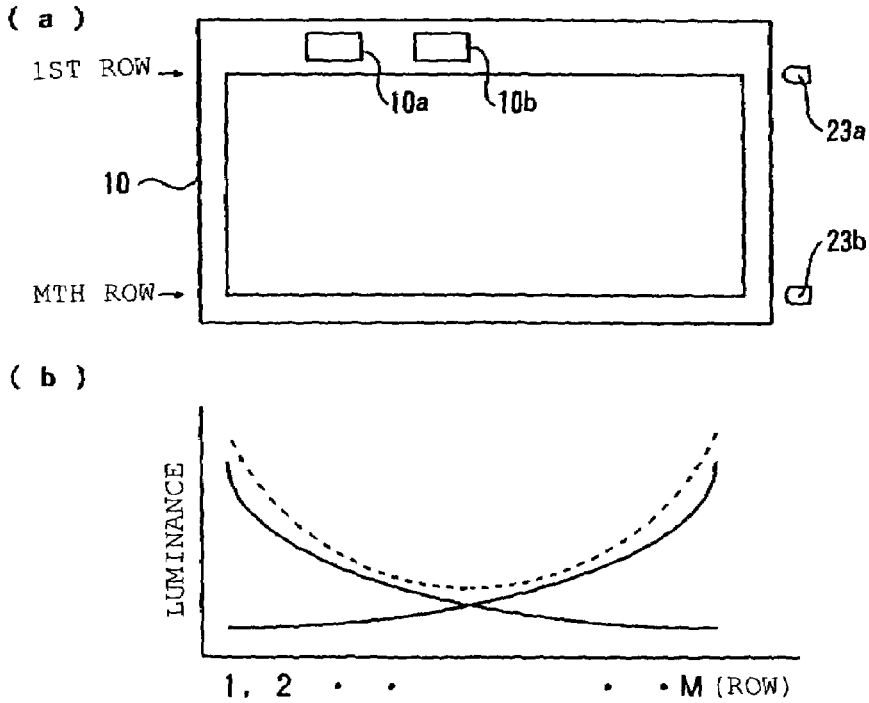
FIGS. 11A and 11B are typical views each illustrating luminance information that is obtained according to the disposition relationship between the pixel that is light-up driven in the display panel and the photo-electric conversion means.

Incidentally, while the example illustrated in FIG. 10 regards the case where, for example, the PIN diode 23 serving as the photo-electric conversion means is disposed near the upper end portion of the panel 10, it is also possible, for example, as illustrated in FIG. 11, to dispose two PIN diodes 23*a* and 23*b* at the position near the upper end portion (near the 1st row) and at the position near the lower end portion (near the mth row). In this case, the relationship of the detected luminance of each of the respective PIN diodes 23*a* and 23*b* to the position of the corresponding pixel light-up driven in the display panel 10 becomes that indicated by each of two solid lines in FIG. 11B.

Accordingly, in case where, as illustrated in FIG. 11, for example the two PIN diodes 23*a* and 23*b* are utilized, it is preferable to construct so that the above-described correction value may be output by using the logical sum of the outputs from the respective PIN diodes 23*a* and 23*b* as the attenuation characteristic indicated by a broken line in FIG. 11B and utilizing this attenuation characteristic as the relevant parameter.

Then, the correction value that has been attained in the step S15 illustrated in FIG. 9 is D/A converted as illustrated in a step S16. This D/A conversion is performed in the way that, as illustrated in the example already explained in connection with FIG. 8, 4-bit control is performed and that the collector potential of the transistor T4 is thereby adjusted. As a result of this, the potential of the output terminal Out of the operational amplifier OP2 functioning as a buffer amplifier is adjusted, and, as a result of this, the setting operation of setting a drive power which is illustrated in a step S17 is performed.

In the control routine illustrated in FIG. 9, the control operation returns from the step S17 to the step S11, whereby the same setting operation is repeatedly carried out. And, in case where in the step S14 it has been determined that the initial luminance has coincided with the set value ("yes" determination is made), the flow proceeds to a step S18, in which the display that uses all the pixels of the display panel 10 is started.

Incidentally, in case where utilizing the luminescent display panel that is constructed in the way that, as stated before, a full color is rendered through synthesizing the luminescent color lights from the luminescent elements corresponding to respective ones of the R, G, and B colors, the routine illustrated in FIG. 9 is executed correspondingly to the relevant luminescent element to a respective one of those colors. In this case, the standard luminance data corresponding to the respective luminescent elements of the R, G, and B colors are held in the CPU 41, thereby adjustment is made of the relevant drive power. As a result of this, it is possible to compensate for the collapse in white balance due to the aging or the variation in the environmental temperature.

Also, in a construction wherein, as illustrated in, for example, 11A, icons 10*a* and 10*b* that constitute the luminescent elements are disposed in part of the display panel 10 in juxtaposed fashion, it sometimes happens that the difference in luminance between the both icons 10*a* and 10*b* becomes outstanding to a relatively large extent and one feels unnatural. In view thereof, the control routine illustrated in FIG. 9 is executed correspondingly to the luminescent element that forms each of the icons 10*a* and 10*b*, thereby adjustment is made of the luminous luminance of respective icons 10*a* and 10*b*. By doing so, it is possible to put the luminance in luminance between the icons, such as that stated above, into a regular order.

When adjusting the drive power applied to the luminescent element as has been explained above, in the display panel 10 of active drive type illustrated in FIG. 5, it is arranged to appropriately set the voltage level at the power source control lines 33-1, 33-2, - - - and, by doing so, to resultantly control the luminescent drive current that is to be applied to the EL element 20. In this case, even when it is arranged that a fixed potential be applied to the power source control lines 33-1, 33-2, - - - illustrated in FIG. 5 and the set voltage that has been calculated by the CPU 41 be applied to the reference power source lines 31-1, 31-2, - - - , it is possible to control the luminescent drive current as used with respect to the EL element and to obtain the adjusted result that is the same as that stated above.

Also, by suitably setting the level of a control signal that corresponds to the image data from a data driver not illustrated, it is possible to control the amount of electric charge that is charged into the capacitor 37 via the data electrode lines 30-1, 30-2, - - - and control TFTs 35*a* and 35*b*. Accordingly, even by adopting the form of control, it is possible to control the luminescent drive current corresponding to the EL element 20 and, thereby, to control the EL element to an appropriate luminance. Further, as will later be explained in detail, by changing the supplying period of time (the lighting-up period of time) of the drive current applied to the EL element, also, it is possible to control the substantial luminance of the EL element. And, these means can also be adopted even in a form that two or more of them are combined together.

Figure 12:
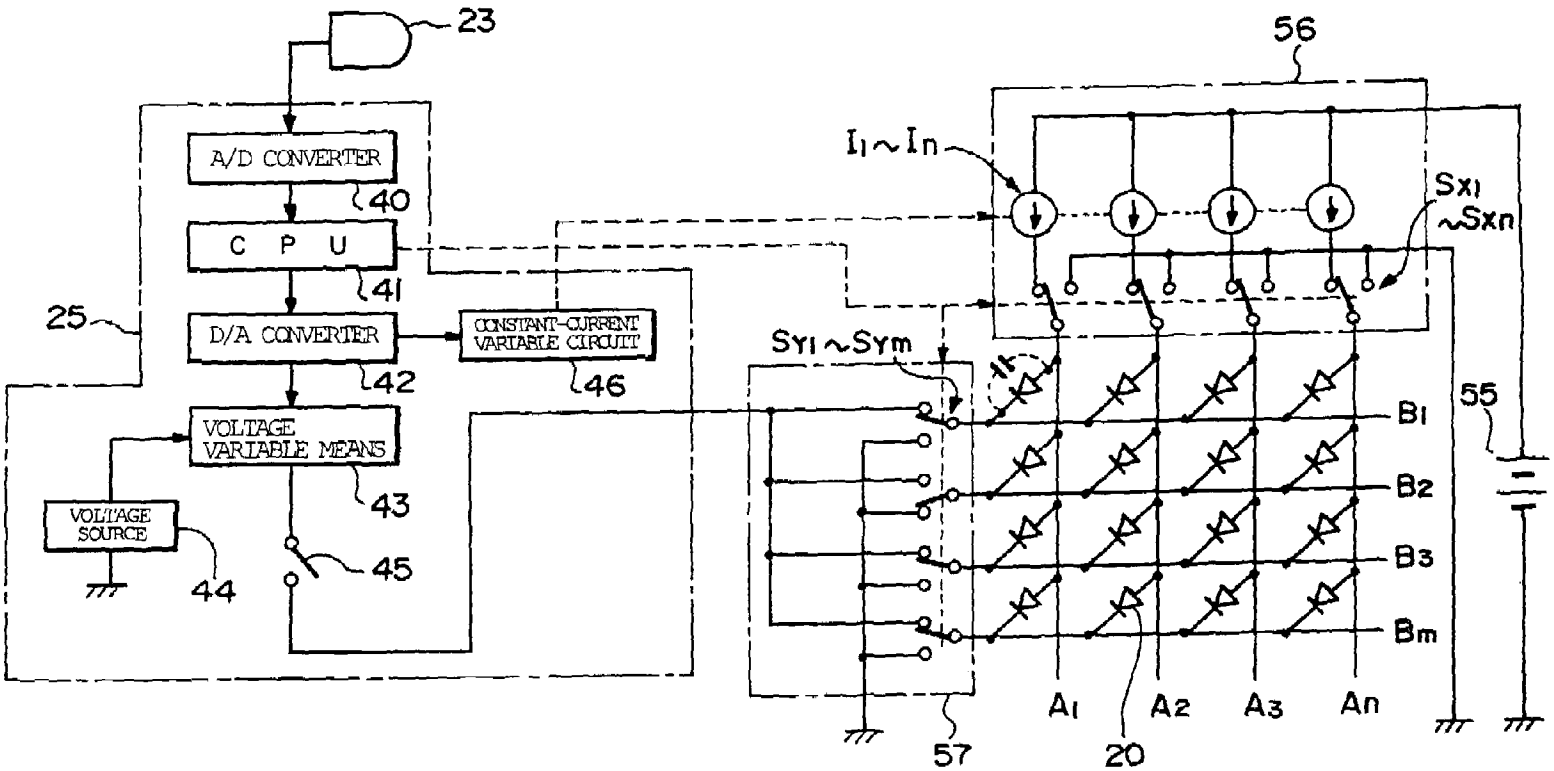
FIG. 12 is a line connection diagram illustrating an example wherein the present invention is applied to the device for driving a passive drive type display panel.

Next, FIG. 12 illustrates a construction that is made up when the present invention has been adopted in a drive device for driving a passive drive type display panel. This passive drive method is also called a simple matrix drive method, and the construction is equipped with an anode line driving circuit 56 and a cathode line scanning circuit 57. As the drive method for driving an organic EL element used in this simple matrix drive method, there are two methods one of which is cathode line scanning/anode line drive and the other of which is anode line scanning/cathode line drive. The form that is illustrated in FIG. 12 is a form of cathode line scanning/anode line drive.

In the display panel used here, the anode lines A1 to An serving as the drive lines and the cathode lines B1 to Bm serving as the scanning lines are arrayed in the form of a matrix. And it is arranged that the organic EL elements 20 is connected at the positions of intersection between the anode lines and the cathode lines that are arrayed in the form of a matrix. And, the anode line driving circuit 56 is connected, via the respective anode lines A1 to An, to the anodes of the respective organic EL element 20 disposed in the display panel, while, on the other hand, the cathode line scanning circuit 57 is connected, via the cathode lines B1 to Bm, to the cathodes of the respective organic EL elements 20 disposed in the display panel.

The cathode line scanning circuit 57 includes switches SY1 to SYm. The cathode line scanning circuit 57 scans while sequentially switching those switches SY1 to SYm to the earth terminal side at prescribed time intervals in the way that the switching corresponds to a synchronizing signal of the image signal. Thereby, an earth potential (0 V) is sequentially applied to the cathode line B1 to Bm. Also, the anode line driving circuit 56 connects a switch SX1 to SXn, in synchronism with the switch scan of the cathode line scanning circuit 57, according to the image data, to the side of constant current source I1 to In driven by a voltage source 55. By doing so, the circuit 56 supplies a drive current to the organic EL element that is located at the desired position of intersection.

In the state illustrated in FIG. 12, only the switch SY2, alone, of the second line of the cathode line scanning circuit 57 is changed over to the earth side, whereby an earth potential is applied to the second cathode line B2. At this time, the switches SX1 to SXn of the anode line driving circuit 56 are connected to the side of the constant current sources I1 to In side, so that a constant current can be applied from the constant current sources I1 to In to the EL element 20 of the second cathode line via the anode line via the anode lines A1 to An. This enables the luminescence of the EL element 20 on the second cathode line.

Incidentally, in this embodiment, it is arranged that, with respect to the cathode lines other than the cathode line B2 that is being scanned, an output voltage from the voltage variable means 43 be supplied. It is thereby arranged that with respect to the EL elements other than that being scanned a reverse bias voltage be applied, whereby the elements other than the EL element which is light-up controlled be prevented from making their erroneous luminescence. And, by repeatedly performing this scanning and driving operation, it is arranged to cause luminescence of the organic EL element at a give position and it is arranged that the respective organic EL elements luminesce as if they are simultaneously lit up.

On the other hand, when performing driving this type of passive drive type display panel, means that is called "the cathode-resetting method" is adopted in which by utilizing the voltage source that applies a reverse bias voltage to the EL elements that are being out of scan a forward-directional voltage is instantaneously pre-charged into the parasitic capacitor of the EL element. This cathode-resetting method is disclosed in, for example, Japanese Patent Application Laid-Open No. HEI-9-232074. By adopting that cathode-resetting method, it is possible to expedite the luminescence-starting timing for lighting up the EL element and it is possible to suppress the substantial decrease in luminance of the passive drive type display panel.

When executing this cathode-resetting method, each time that the respective cathode lines B1 to Bm are scanned, the operations of connecting all of the respective scanning switches SX1 to SXn to the earth and of also connecting all of the respective switches SX1 to SXn of the anode line side to the earth are performed. As a result of this, the electric charge accumulated in the parasitic capacitor of the EL element of the display panel is wholly reset. And, connection to the voltage source for applying the above-described reverse bias voltage is made of the scanning switches corresponding to the respective scanning lines other than that to be scanned the next. By doing so, it is possible to concentratedly pre-charge the above-described reverse bias voltage into the parasitic capacitor of the EL element that is going to be light-up driven the next via each of the parasitic capacitors of the other EL elements.

By the way, regarding the construction wherein pre-charge with respect to the parasitic capacitor of the EL element going to be light-up driven the next by utilizing the voltage source for applying the above-described reverse bias voltage, the inventors of this application recognize that the luminance of the EL element substantially changes depending on the pre-charging voltage, i.e. the value of the reverse bias voltage. This is thought because the pre-charged amount into the parasitic capacitor is changed correspondingly to the value of the reverse bias voltage, and, correspondingly thereto, the luminescent drive energy (luminescence-driving energy) of the EL element changes.

The construction illustrated in FIG. 12 is illustrated as an example wherein the output level of the reverse bias voltage source for pre-charging the parasitic capacitor of the EL element is controlled by the light-reception output of, for example, the PIN diode serving as the above-described photo-electric conversion means 23. And, the drive power setting means illustrated by the reference symbol 25 in FIG. 12 has almost the same construction as that illustrated in FIG. 5. The blocks that correspond between the both figures are denoted by the same reference symbols. Accordingly, the functions and operations of the respective blocks denoted by the reference symbols 40 to 45 will have their explanation omitted.

According to the construction illustrated in FIG. 12, the drive power setting means 25 operates, according to the light detection voltage that is produced by the PIN diode serving as the photo-electric conversion means 23, to appropriately set the value of the reverse bias voltage that is supplied to each cathode line. As stated in the beginning of the explanation of the control routine illustrated in FIG. 9, the setting operation can be performed at the time of starting the light-up drive of the luminescent display panel, or at a fixed time (for each prescribed passage time) during the display operation of the luminescent display panel, or during an arbitrary operation mode, or through a user's operation.

For example, in case where due to the aging or due to the variation in the environmental temperature the amount of light that the photo-electric conversion means 23 receives has become smaller than a reference level value, the voltage variable means 43 of the drive power setting means 25 controls so as to make larger the value of the reverse bias voltage and sets to the state. As a result of this, the amount of charge that is pre-charged into the parasitic capacitor of the EL element 20 increases and this can raise the substantial luminance of the EL element. Also, for example, in case where due to the variation in the environmental temperature, etc. the amount of light that the photo-electric conversion means 23 receives has become greater than the reference value, the action that is reverse from that mentioned above works. As a result of this, the EL element is set to a state of its luminance being decreased.

Figure 13:
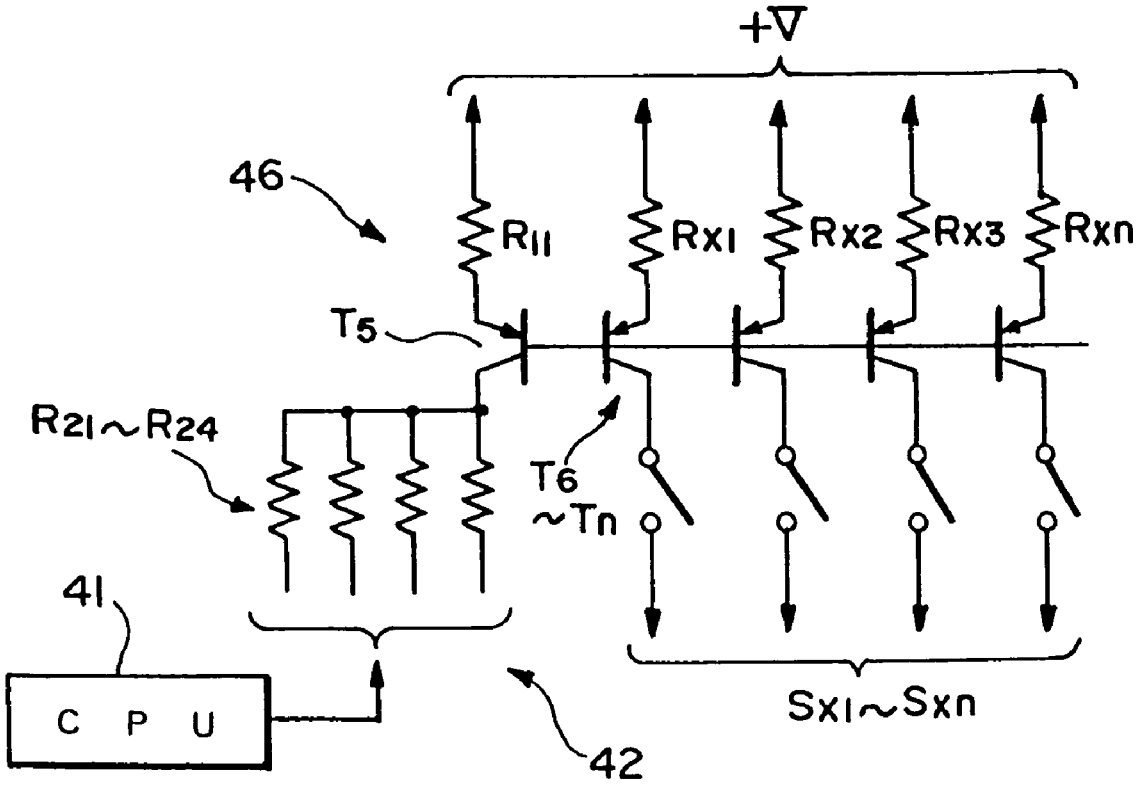
FIG. 13 is a line connection diagram illustrating a specific example of a constant-current variable means in FIG. 12.

In the passive drive display panel illustrated in FIG. 12, as the means for controlling the luminous luminance of the EL element there can also be suitably utilized a construction that uses a constant-current variable circuit indicated by the reference numeral 46 in FIG. 12. A specific construction that is needed when using the constant-current variable circuit 46 is illustrated in FIG. 13. In this case, from the CPU 41, there is issued a command that instructs that one ends of resistors R21 to R24 functioning as a D/A converter 42 be selectively connected to, for example, a reference potential point. Namely, here, through a 4-bit control, there is controlled the collector current (lead-in current) of a pnp transistor T5 constituting the constant-current variable circuit 46.

On the other hand, the emitter of the transistor T5 is connected to a positive electrode terminal (+V) of the voltage source 55 illustrated in FIG. 12. And, the bases of the pnp transistors T6 to Tn functioning as the constant-current sources I1 to In illustrated in FIG. 12 are commonly connected to the base of the transistor T5. Further, the emitters of the transistors T6 to Tn are connected, via resistors RX1 to RXn, to the positive electrode terminal (+V) of the voltage source 55 illustrated in FIG. 12. With that construction, it is possible, as the collector current of the transistor T5 changes, to control the collector current of the transistors T6 to Tn, that is, the drive current that is selectively supplied to the EL elements 20 via the switches SX1 to SXn.

Accordingly, in a case where adopting the passive drive type display panel, even when adopting the form of control illustrated in FIG. 13, it is possible to control the luminescent drive current as applied to the EL element 20 and, thereby, to control the EL element to an appropriate value of luminance. Further, as explained later in detail, it is also possible to control the luminance of the luminescence made by the EL element, also, by changing the supplying period of time (the light-up period of time) of supplying the drive current applied to the EL element. And, these means mentioned just above can also be adopted in a form that two or more of them are combined.

Figure 14:
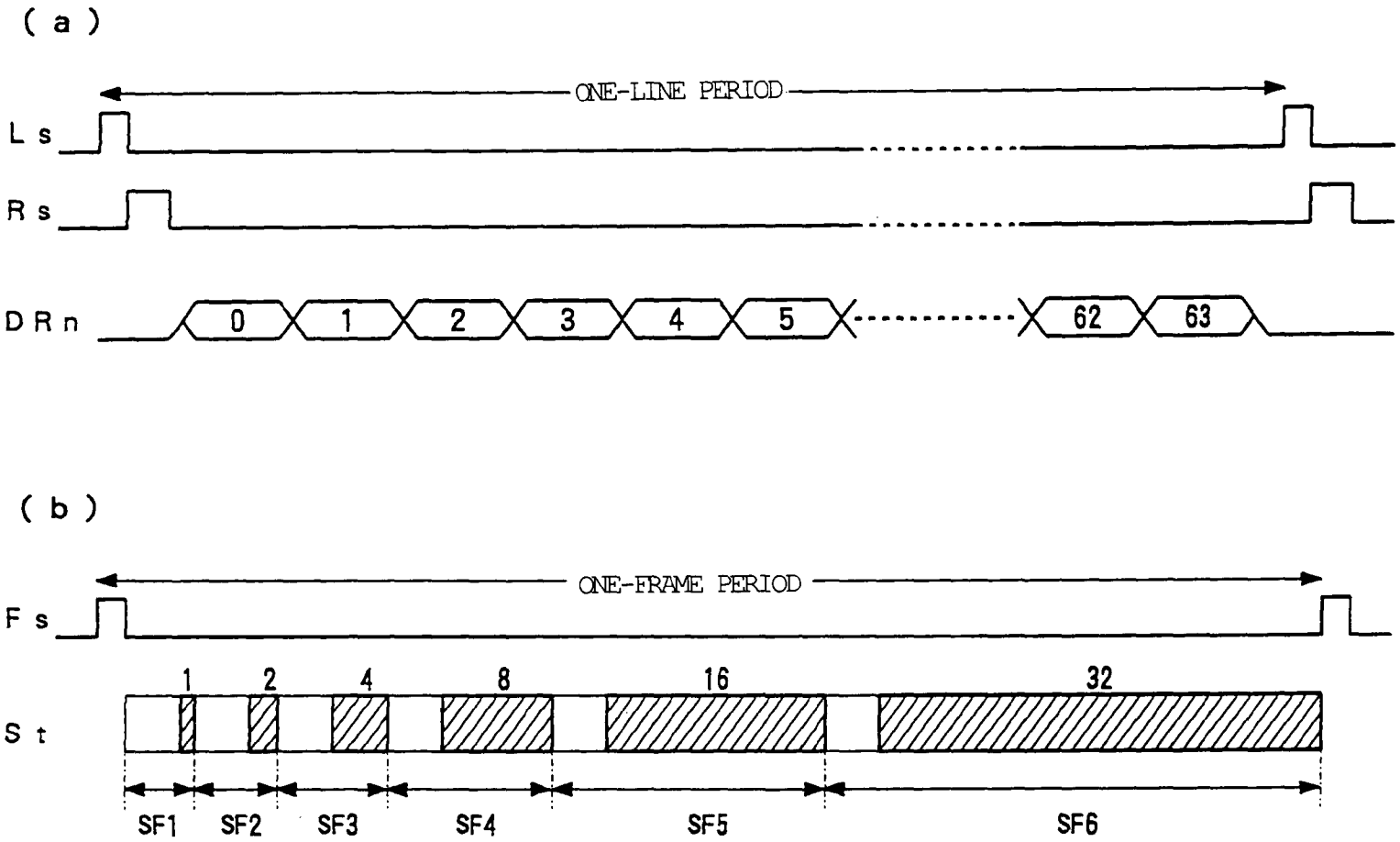
FIG. 14 is a timing chart illustrating an example of controlling substantial luminance by changing the supplying time period in which a drive current is applied to the luminescent element.

FIG. 14A illustrates an example wherein, in case where adopting the passive drive type display panel, the substantial luminance of the EL element is controlled by changing the supplying period of time (the light-up period of time) of supplying the drive current applied to the EL element. Namely, this means can be realized by time-division driving the switches SX1 to SXn of the anode line drive circuit 56 and the switches SY1 to SYm of the cathode line scanning circuit 57 from the CPU 41 in FIG. 12. Namely, as illustrated in FIG. 4A, in synchronism with a line sync Ls indicating a one line of the display, the above-described cathode-resetting operation RS is executed, and, in the remaining period subsequent to the cathode-resetting operation Rs, the control of the luminance (the control of the color gradation) is executed.

Here, in the control period that corresponds to the DRn-indicated above-described control of gradation, as illustrated in FIG. 14A, relevant control is performed so that the EL element may be lit up on a time-divisional basis. Namely, the light-up enabled period in the one-line period of the display is divided into parts 0 to 63, and, by selectively light-up driving these partial periods, 64 gradation (gray levels) can be expressed through a 6-bit control. Accordingly, by utilizing the means, it is possible to realize appropriate luminescent control of the display panel.

Also, FIG. 14B illustrates an example wherein, in a case where adopting the active drive type display panel, control is performed of the substantial luminance of the EL element by changing the supplying period of time (the lighting-up period of time) of supplying the drive current applied to the EL element. Namely, in this example, its relevant construction is made in the form that the one-frame period that is determined by the frame synchronizing signal Ls is divided into 6 sub-frames (SF1 to SF6) the periods of that are different from one another; and, in the respective sub-frame periods, as indicated by the oblique lines, the light-up periods (also called "the sustain period") the period length ratio of that is 1:2:4:8:16:32 are set. Accordingly, by selecting these light-up periods suitably or in combined form, 64 gradation can be expressed through the use of a 6-bit format. Incidentally, the respective portions in the respective sub-frames that are rendered white represent the addressing periods of time.

In this case as well, in the same way, it is possible to realize appropriate luminescent control of the display panel. Also, as was illustrated in, for example, FIG. 3, in the case where applying a full-color display panel based on the utilization of the parallel type RGB method, by setting the luminance with respect to each of the luminescent elements corresponding to the respective R, G, and B, color balance can be put in regular order.

Figure 15:
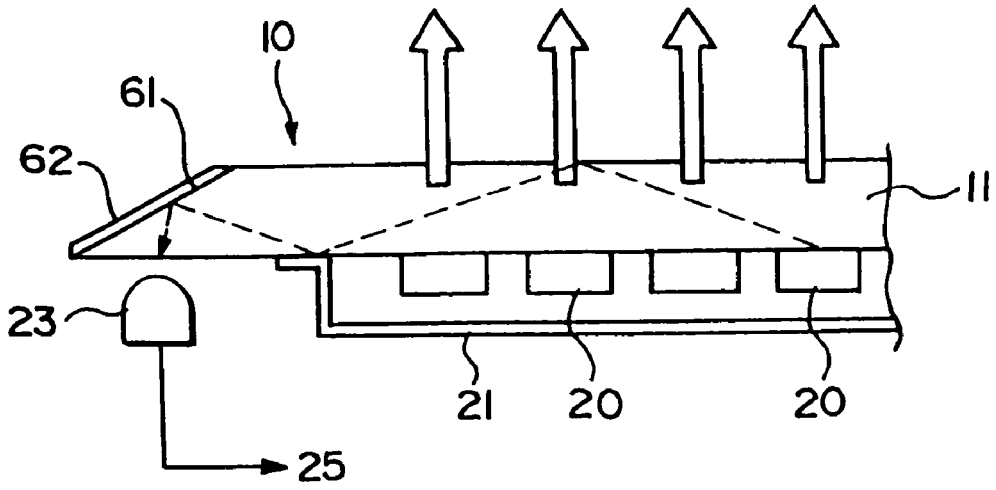
FIG. 15 is a sectional view illustrating a second embodiment that detects the amount of light that is reflected within the substrate.

Next, FIG. 15 illustrates by a sectional view a second embodiment directed to detecting the amount of light reflected within the transparent substrate 11 constituting the display panel 10. Incidentally, in FIG. 15, the same functional portions as those already explained in connection with FIG. 4 are denoted by the same reference symbols, and, therefore, a detailed explanation thereof will be omitted. In this embodiment illustrated in FIG. 15, a reflecting surface 61 is formed in the substrate surface of the transparent substrate 11 at an angle that is prescribed with respect thereto. The light indicated by a broken line that is total-reflected with the substrate surface serving as the interface is reflected toward the reverse surface side of the substrate 11 by the reflecting surface 61.

Accordingly, in this construction, by disposing, for example, the PIN diode serving as the photo-electric conversion means 23 on the reverse surface side of the transparent substrate 11 constituting the display panel 10, it is possible to detect the amount of light that has been reflected by the reflecting surface 61. Incidentally, in this case, it is also thought possible to apply a reflecting material 62 with respect to the reflecting surface 61 according to the necessity.

Figure 16:
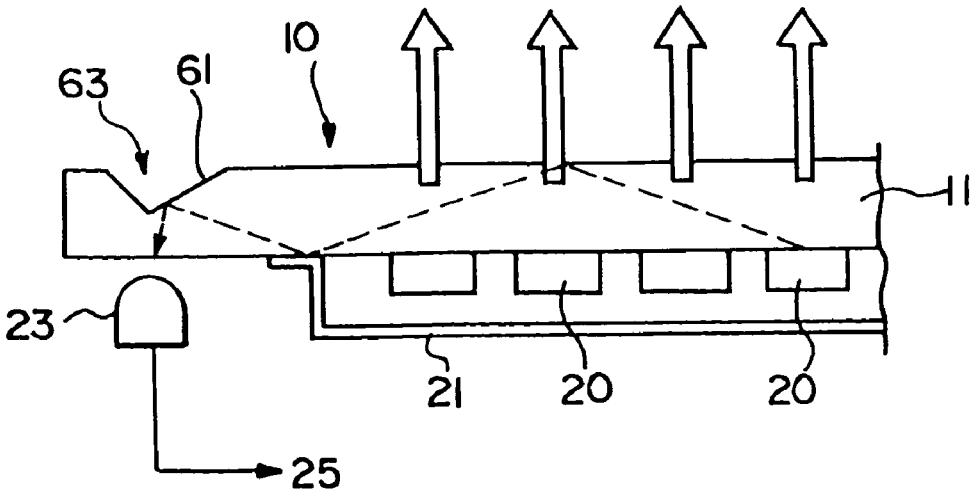
FIG. 16 is a sectional view illustrating a third embodiment for attaining the same purpose.

Also, FIG. 16 illustrates by a sectional view a third embodiment directed to detecting the amount of light that is similarly reflected within the transparent substrate 11. In this embodiment illustrated in FIG. 16, along in the neighborhood of the end of the transparent substrate 11, there is formed a groove portion 63 that is constructed so that its sectional configuration may be shaped like a V. And, a relevant construction is made so that one surface of the groove portion may be utilized as the reflecting surface 61. In this construction as well, as in the case of the example illustrated in FIG. 15, for example, the PIN diode serving as the photo-electric conversion means 23 is disposed on the reverse surface side of the transparent substrate 11 constituting the display panel 10, which enables detecting the amount of light that is reflected by the reflecting surface 61.

Figure 17:
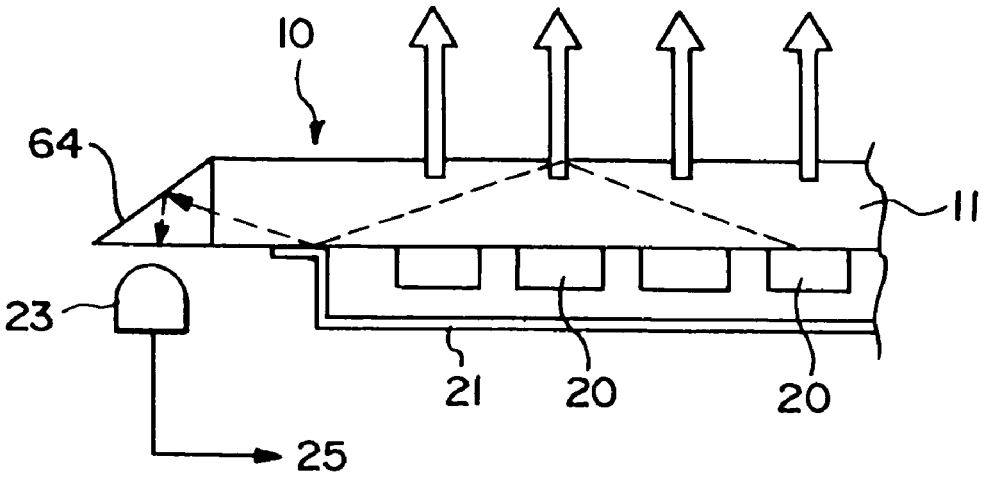
FIG. 17 is a sectional view illustrating a fourth embodiment for attaining the same purpose.

FIG. 17 illustrates by a sectional view a fourth embodiment directed to detecting the amount of light that is similarly reflected within the transparent substrate 11. In this embodiment illustrated in FIG. 17, a prism member 64 is disposed at the end of the transparent substrate 11. A relevant construction is made in the way that the light indicated by a broken line that is reflected within the transparent substrate 11 via the prism member 64 is drawn out toward the reverse surface side of the substrate 11. In this construction as well, by disposing, for example, the PIN diode on the reverse surface side of the transparent substrate 11 constituting the display panel 10, it is possible to detect the amount of light that has been reflected by the prism member 64.

Figure 18:
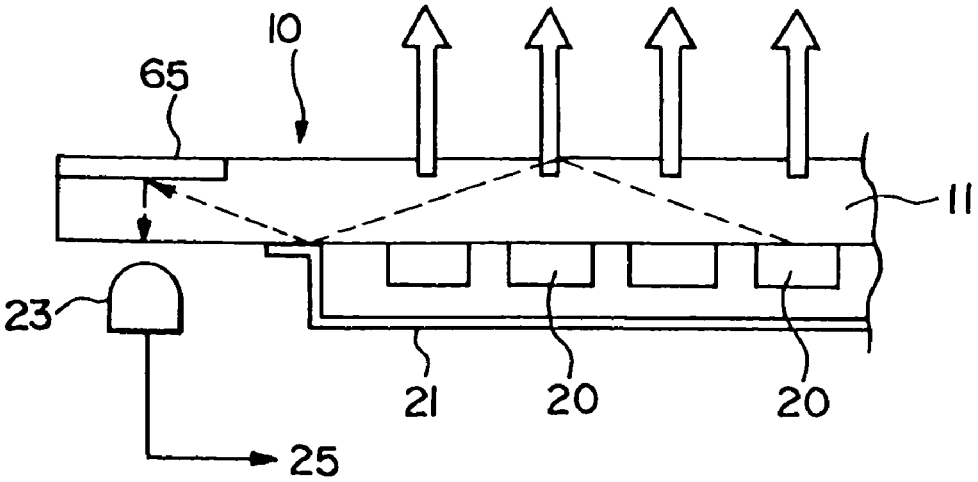
FIG. 18 is a sectional view illustrating a fifth embodiment for attaining the same purpose.

Incidentally, in the construction illustrated in FIG. 17, even when disposing the light-diffusion member that is formed into the same configuration by using a lactescent material instead of the prism member 64, the amount of light can be detected also similarly. Also, in case where utilizing the light-diffusion member, as illustrated in, for example, FIG. 18, the light-diffusion member 65 formed like a flat plate configuration may be disposed along one surface of the transparent substrate 11. By doing so, similarly, the amount of light that is reflected within the transparent substrate 11 can be detected.

Figure 19:
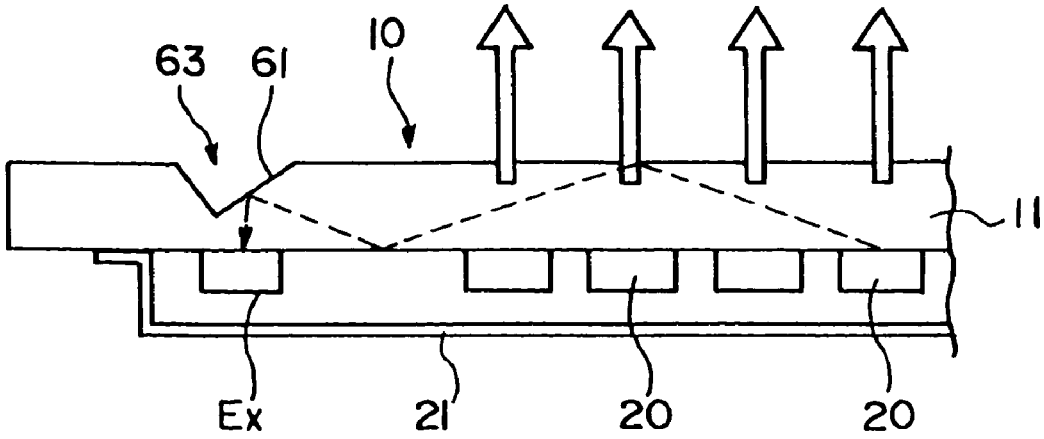
FIG. 19 is a sectional view illustrating a sixth embodiment for attaining the same purpose.

Incidentally, in the embodiments explained as described above, each of them is constructed in the way the light-receiving element serving as the photo-electric conversion means is equipped separately from the display panel. However, it is also possible to utilize the EL element that has been lamination-formed on the substrate of the display panel, as the light-receiving element. FIG. 19 illustrates a single piece of the example by a sectional view. An EL element Ex for reception of the light that is not utilized as the display function is added. Namely, in the embodiment illustrated in FIG. 19, on one surface of the substrate 11, the EL elements 20 for use for luminescence are formed by the film-forming technique, while, on the other hand, simultaneously, the EL element Ex for use for reception of the light is also formed.

And, in the same way as in the example illustrated in FIG. 16, along in the vicinity of the end of the substrate 11 there is formed a groove portion 63 the sectional configuration of which is shaped like a V, and one surface of the groove portion is used as the reflecting surface 61, thereby the reflected light indicated by a broken line can be introduced into the light-receiving EL element Ex. Here, in case where applying a prescribed constant voltage in the forward direction, the organic EL element has a characteristic that a forward-directional voltage changes correspondingly to the external light that the EL element receives. In this case, as the amount of light that the EL element receives increases, the characteristic that the forward-directional voltage of the element decreases is exhibited.

Figure 20:
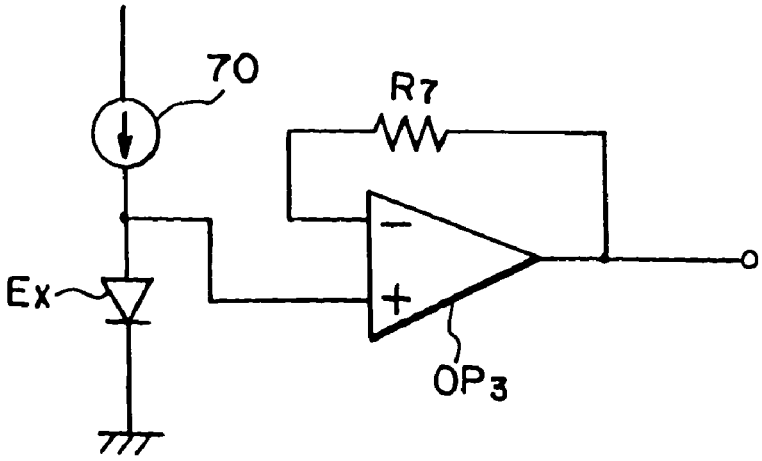
FIG. 20 is a line connection diagram illustrating an example of the photo-electric conversion circuit that is utilized in the construction illustrated in FIG. 19.

FIG. 20 illustrates an example that constitutes a photo-electric conversion circuit by utilizing the dependency of the forward-directional voltage on the luminance that the EL element Ex receives. Namely, a relevant construction is made in the way that to the anode electrode of the EL element Ex there is supplied a prescribed level of current via a constant-current source 70. And, the anode is connected to the non-inversion input terminal of an operational amplifier OP3. Incidentally, the operational amplifier OP3 is formed into a known negative feedback buffer wherein a feedback R7 is connected between the output terminal and inversion input terminal thereof. Accordingly, at the output terminal of the operational amplifier OP3 there appears a D.C. voltage corresponding to the forward-directional voltage of the EL element Ex.

Accordingly, by causing a relevant signal to be input to, for example, the A/D converter illustrated in FIG. 7 utilizing the output voltage of the operational amplifier OP3 illustrated in FIG. 20, as already explained before, it is possible to appropriately set the luminescent drive power applied to the EL element.

In the embodiments explained above, it is arranged that, utilizing the transparent substrate 11 having lamination-formed thereon, for example, the organic EL element serving as the luminescent element, an electric signal be obtained when, by doing so, receiving the light from the luminescent element that is reflected within the substrate with that substrate surface serving as the interface. However, as illustrated in, for example, FIG. 21, it can also be arranged that, utilizing a light-guiding substrate having further laminated on the transparent substrate 11, an electric signal be obtained when receiving the light from the luminescent element that is reflected with the substrate surface being used as the interface.

Figure 21:
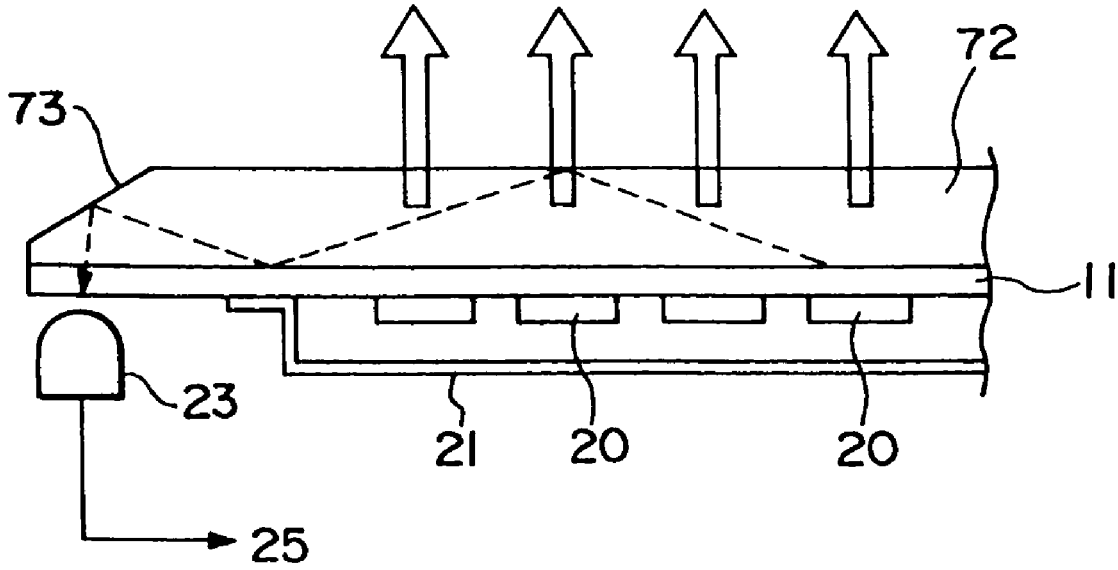
FIG. 21 is a sectional view illustrating a seventh embodiment for detecting the amount of light that is reflected within the substrate.

Namely, in FIG. 21, the same functional portions as those in, for example, FIG. 4 already explained are denoted by the same reference symbols and, therefore, their detailed explanation will be omitted. In the form illustrated in FIG. 21, on the frontward surface of the transparent substrate 11 having lamination-formed thereon, for example, the organic EL element 20 serving as the luminescent element, there is further mounted in the way of its being laminated thereon a light-guiding substrate 72 at an angle that is prescribed with respect to the substrate surface of it. And, a reflecting surface 73 is formed with respect to the light-guiding substrate 72 at an angle that is prescribed with respect to the substrate surface. As a result of this, the light indicated by a broken line that is total-reflected with the substrate surface of the light-guiding substrate 72 being used as the interface is reflected by the reflecting surface 73 toward the reverse surface side of the substrate 11 via the light-guiding substrate 72 and the transparent substrate 11.

Accordingly, in this construction, by disposing, for example, the PIN diode serving as the photo-electric conversion means 23 on the reverse surface side of the transparent substrate 11 constituting the display panel 10, it is possible to detect the amount of light that has been reflected by the reflecting surface 73 formed on the light-guiding substrate 72. According to the construction utilizing the light-guiding substrate 72 in that way, it is possible to easily apply the present invention even with respect to the display that is shaped like a film.

Incidentally, in the construction utilizing the light-guiding substrate 72 as stated above, an available construction is not limited to the construction wherein the reflecting surface 73 is formed at an angle that is prescribed with respect to the substrate surface of the light-guiding substrate 72 as illustrated in FIG. 21. Namely, it is also possible to suitably adopt the construction of photo-electric conversion that was illustrated in each of FIG. 4 and FIGS. 16 to 18. Also, it is also possible to make concurrent use of the construction that utilizes as the light-receiving element the EL element Ex, i.e. as the photo-electric conversion element illustrated in FIG. 19, the EL element Ex that has been lamination-formed on the substrate of the display panel.

What is claimed is:

1. A device for driving a luminescent display panel which is adapted to obtain a display image by lamination-forming on a transparent substrate a luminescent element including an electrode and a luminescent function layer and causing a light from the luminescent element to be radiated via the transparent substrate in a direction of its intersecting the surface of the substrate at a right angle with respect thereto, comprising photo-electric conversion means that receives the light from the luminescent element which, by using as the interface the substrate surface of the transparent substrate or a substrate surface of a light guiding substrate disposed on the transparent substrate in a laminated state, is reflected within the substrate, to thereby produce an electric signal, and drive power setting means that, according to the electric signal obtained from the photo-electric conversion means, sets a luminescent drive power that is supplied to each of the respective luminescent elements.

2. The device for driving a luminescent display panel according to claim 1, wherein the photo-electric conversion means is constructed by a light-receiving element disposed at a position that opposes a side end surface of the substrate.

3. The device for driving a luminescent display panel according to claim 1, wherein the photo-electric conversion means is constructed by a light-receiving element disposed at a position that opposes a reflecting surface that is formed at an angle that is specified with respect to the substrate surface of the substrate.

4. The device for driving a luminescent display panel according to claim 3, wherein one surface of a groove portion formed in the substrate is constructed so that it may be used as the reflecting surface.

5. The device for driving a luminescent display panel according to claim 1, wherein the photo-electric conversion means is constructed by a light-receiving element that is disposed in the way that it opposes a light-diffusing member or light-reflecting member that is located on a side end surface of the substrate or one surface thereof.

6. The device for driving a luminescent display panel according to one of claims 1 to 5, wherein the luminescent element is constructed by an organic EL element that uses an organic compound as the material of the luminescent function layer.

7. The device for driving a luminescent display panel according to claim 6, wherein the organic EL element lamination-formed on the transparent substrate is utilized as the light-receiving element.

8. A method of driving a luminescent display panel which is adapted to obtain a display image by lamination-forming on a transparent substrate a luminescent element including an electrode and a luminescent function layer and causing a light from the luminescent element to be radiated via the transparent substrate in a direction of its intersecting the surface of the substrate at a right angle with respect thereto, comprising the step of receiving the light from the luminescent element which, by using as the interface the substrate surface of the transparent substrate or a substrate surface of a light guiding substrate disposed on the transparent substrate in a laminated state, is reflected within the substrate, to thereby produce an electric signal, and the step of executing a setting operation of setting a luminescent drive power that is supplied to each of the respective luminescent elements according to the electric signal.

9. The method of driving a luminescent display panel according to claim 8, wherein the setting operation of setting a luminescent drive power is performed by any one or any two or more of an operation of setting the magnitude of a drive current applied to the luminescent element, an operation of setting the supplying time period for supplying a drive current applied to the luminescent element, and an operation of setting the magnitude of a pre-charge voltage for performing electric pre-charge with respect to a parasitic capacitor of the luminescent element being adopted singly or adopted in combination.

10. The method of driving a luminescent display panel according to claim 8, wherein the setting operation of setting a luminescent drive power is performed at a point in time when the light-up of the luminescent display panel starts to be driven, or at a prescribed point in time during the display operation of the luminescent display panel, or through a user's operation.

11. The method of driving a luminescent display panel according to claim 9, wherein the setting operation of setting a luminescent drive power is performed at a point in time when the light-up of the luminescent display panel starts to be driven, or at a prescribed point in time during the display operation of the luminescent display panel, or through a user's operation.

12. The method of driving a luminescent display panel according to one of claims 8 to 11, wherein the luminescent display panel is adapted to reproduce a full color by synthesizing the color lights from the luminescent elements corresponding to respective ones of red (R), green (G), and blue (B) colors, and wherein the setting operation of setting a luminescent drive power is performed in each of the luminescent elements corresponding to respective ones of red (R), green (G), and blue (B) colors.

13. The method of driving a luminescent display panel according to one of claims 8 to 11, wherein the setting operation of setting a luminescent drive power is performed by utilizing as the parameters a photo-attenuation characteristic that is based on the positional relationship between each of the luminescent elements arrayed on the transparent substrate and a light-receiving element that produces an electric signal upon receipt of a light from the luminescent element.

14. The method of driving a luminescent display panel according to claim 12, wherein the setting operation of setting a luminescent drive power is performed by utilizing as the parameters a photo-attenuation characteristic that is based on the positional relationship between each of the luminescent elements arrayed on the transparent substrate and a light-receiving element that produces an electric signal upon receipt of a light from the luminescent element.

* * * * *